United States Patent [19]

Cantor

[11] Patent Number: 4,995,436

[45] Date of Patent: Feb. 26, 1991

[54] ANTI-THEFT HANDBAG

[76] Inventor: Joseph L. Cantor, 175 E. Mt. Pleasant Ave., Livingston, N.J. 07039

[21] Appl. No.: 368,412

[22] Filed: Jun. 16, 1989

[51] Int. Cl.[5] ..... A45C 1/02; A45C 3/06; A45C 13/18; A45C 13/22

[52] U.S. Cl. ..... 150/102; 150/107; 150/108; 150/111; 150/113; 190/101; 190/108; 190/110; 190/116; 383/37

[58] Field of Search ..... 190/101, 102, 108, 109, 190/110, 116; 150/101, 102, 111, 113, 117, 107; 383/11, 37, 40; D3/71

[56] References Cited

U.S. PATENT DOCUMENTS

| | | | |
|---|---|---|---|
| D. 182,126 | 2/1958 | Kontoff et al. | D3/71 X |
| D. 224,072 | 6/1972 | Rosenblum | 150/113 X |
| 2,851,076 | 9/1958 | Stakofsky | 150/28 |
| 3,696,850 | 10/1972 | Rosenblum | 190/108 |
| 3,727,657 | 4/1973 | Landis | 150/111 X |
| 3,831,651 | 8/1974 | Leahy | 150/111 X |
| 3,881,534 | 5/1975 | Gist | 150/111 |
| 4,104,164 | 2/1979 | Staup | 190/101 X |
| 4,424,841 | 1/1984 | Smith | 190/108 X |
| 4,546,863 | 10/1985 | Kaufman | 190/900 X |
| 4,804,122 | 2/1989 | Knox | 150/111 X |
| 4,811,768 | 3/1989 | Williams | 383/11 X |

FOREIGN PATENT DOCUMENTS

| | | | |
|---|---|---|---|
| 3600794 | 8/1986 | Fed. Rep. of Germany | 190/110 |
| 840343 | 7/1960 | United Kingdom | 190/110 |

*Primary Examiner*—Sue A. Weaver
*Attorney, Agent, or Firm*—Jeffrey S. Steen

[57] ABSTRACT

A method and means of safely securing valuables in the form of a break-away handbag. Removable reattachable adjacent bag segments are mounted to each other by means of snaps, VELCRO or the like. One or more bag segments act as a decoy and are positioned facing out and away from the body of the handbag holder while other adjacently placed bag segments designed to hold valuables are positioned more proximate to or up against the handbag holder's body. A shoulder strap is attached to a decoy bag segment and is hung over the user's shoulder. Cavities created between each of the adjacent bag segments are capable of enveloping the handbag holder's hand. When an extraordinary pulling force is exerted upon a decoy bag segment or segments, they will separate from the adjacent valuables bag segment or segments and said valuables bag segment or segments will be retained against or between the handbag holder's hand and body.

18 Claims, 5 Drawing Sheets

ANTI-THEFT HANDBAG

BACKGROUND OF THE INVENTION

This invention relates to carrying cases designed to prevent the loss of valuables due to theft. Pedestrians or bicycle riders carrying valuables in a handbag or shoulderbag in a modern crowded urban environment should be concerned with the possibility that a thief could snatch the bag and steal any valuables contained therein.

Unfortunately, the victim of a so-called "purse snatching incident" is commonly pulled or dragged along as the thief yanks the carrying case or the strap associated with the case. Such an occurrence can severely jeopardize the life or limb of the victim, especially near a crowded motorway.

Various attempts have been made to solve these problems but until the instant invention, these attempts have been unsatisfactory because of clumsiness, expense, unsightliness and the lack of an adequately safe and frictionless release system.

The present invention solves these problems by providing a unique system of easily detachable and reattachable adjacent bag segments, some of which remain secure with the victim during a purse snatching incident while others detach and act to decoy the thief.

Accordingly, it is an object of this invention to provide the handbag holder with a means of safely securing valuables during a purse snatching incident.

Another object of this invention is to insure that the victim of a purse snatching incident is not dragged along with the stolen handbag.

Yet another object of this invention is to insure a quick and relatively frictionless separation of handbag segments during a purse snatching incident thus allowing the victim to disengage from the perpetrator as quickly as possible.

A further object of this invention is to dupe a thief into believing that he or she has made off with their booty, thus minimizing the risk that the thief will continue to harass the victim.

A still further object of this invention is to provide a cosmetically and artistically appealing design that is light in weight with a minimum of encumbrances, all contained in a convenient and highly functional device.

All the foregoing and still further objects and advantages of this invention will become apparent from a study of the following specification.

DETAILED DESCRIPTION OF THE INVENTION

Figure 1:
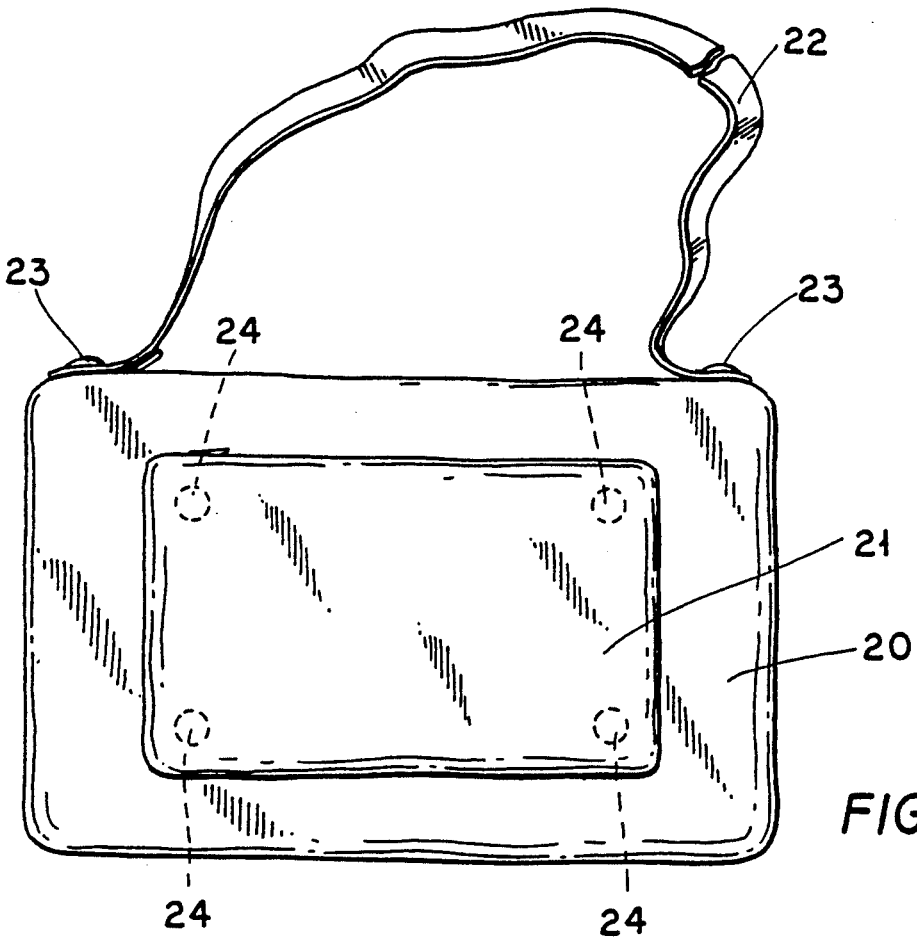
FIG. 1 is a back view of a handbag embodying this invention.
Figure 2:
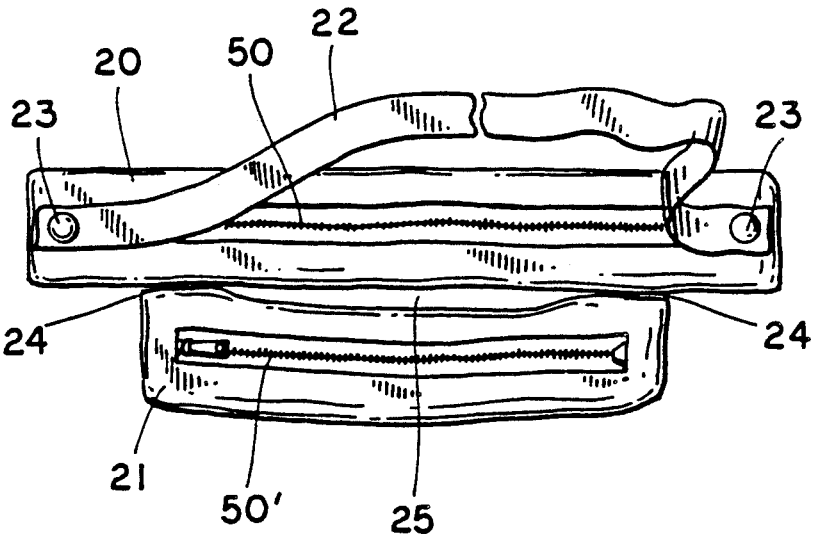
FIG. 2 is a top view of the handbag as in FIG. 1.
Figure 3:
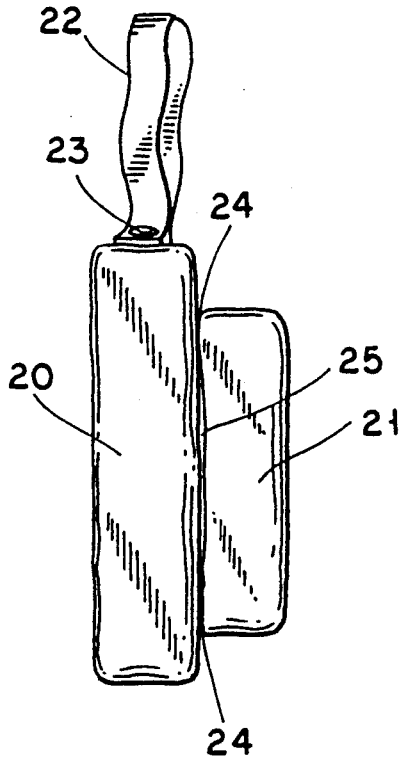
FIG. 3 is a side view of a handbag as in FIG. 1.

Referring first to the form shown in FIGS. 1 through 3 of the drawings, this example of the invention embodies two adjacent bag segments. The decoy bag segment 20 is detachably mounted to the valuables bag segment 21. In normal use the valuables bag segment 21 is positioned so that it is the closest bag segment in relation to the user's body when the user is walking or riding. Consequently, the decoy bag segment 20 faces away from the body of the handbag holder.

Figure 7:
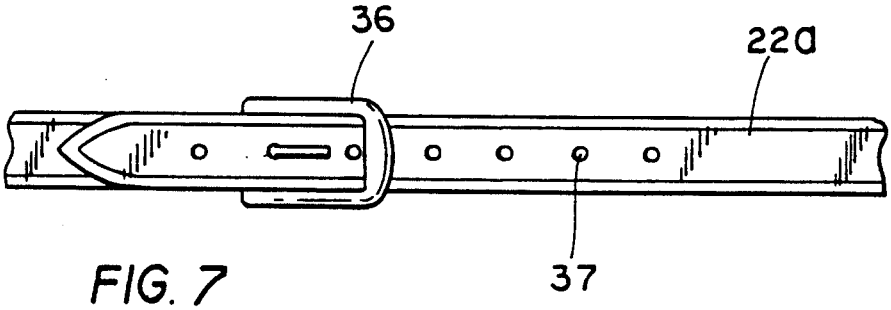
FIGS. 7 and 8 are fragmentary top views of an adjustable carrying strap and adjusting means.
Figure 8:
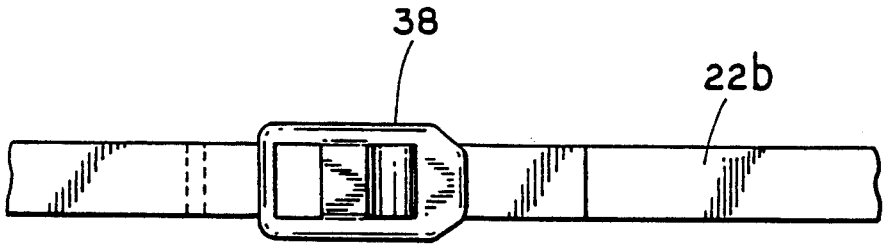
Figure 9:
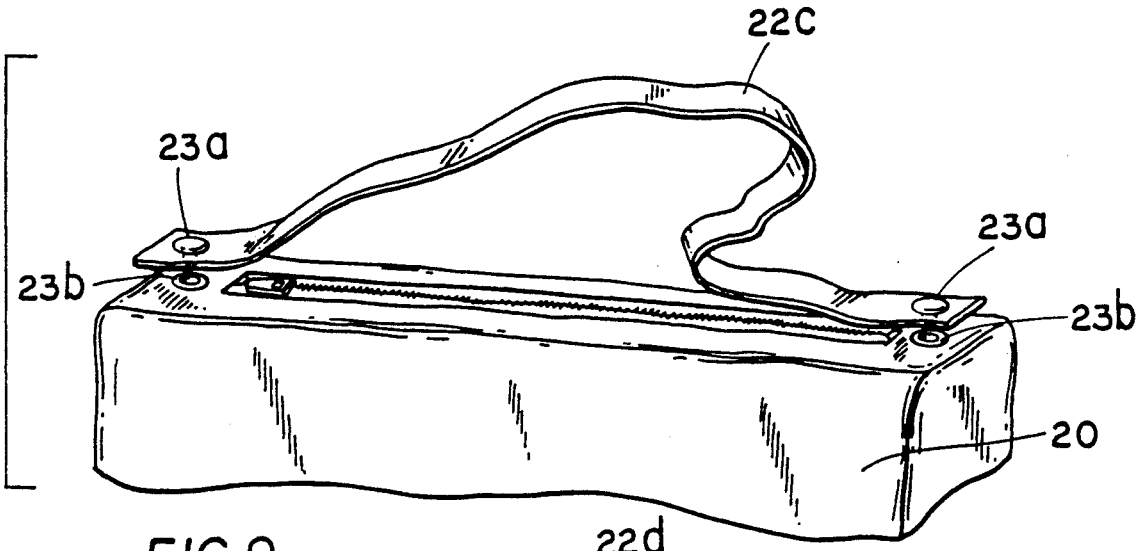
FIG. 9 is a fragmentary view of the anti-theft handbag depicting a carrying strap that can be removably and reattachably mounted at both ends.
Figure 10:
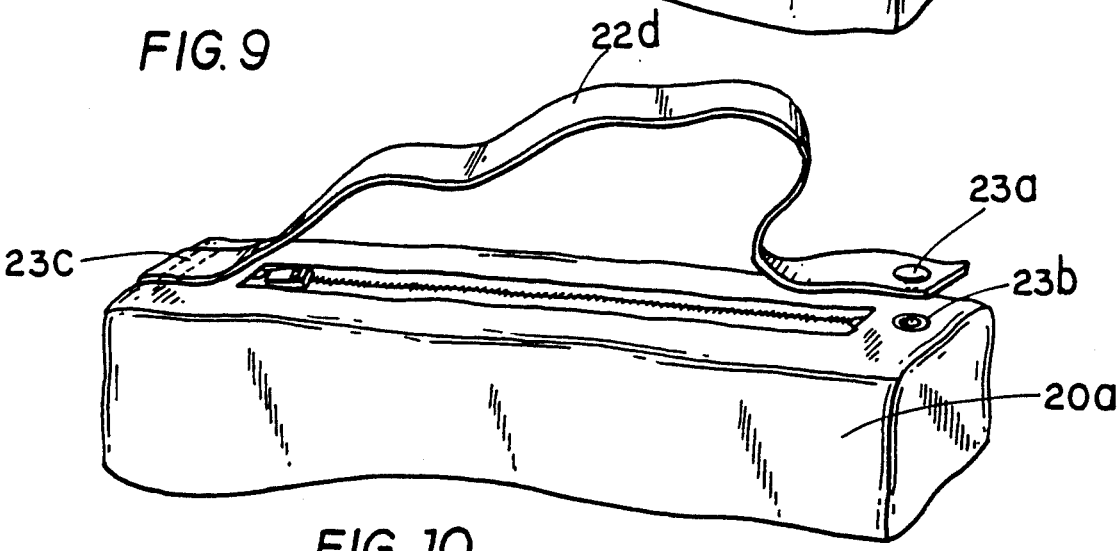
FIG. 10 is a fragmentary view of the anti-theft handbag depicting a carrying strap that is permanently attached at one end and reattachable at the other end.

The decoy bag segment 20 has a carrying strap 22 mounted to it by way of an attaching means 23. One end of the strap 22 may be permanently fixed to the decoy bag segment 20 and removably and reattachably fixed at the other end. Alternatively, both ends of the carrying strap 22 may be removably and reattachably fixed to the decoy bag segment 20 or the carrying strap 22 may be permanently fixed to the decoy bag segment 20. The attaching means 23 may be a snap or VELCRO the like when the object is to make the carrying strap 22 detachable. VELCRO ® is a hook and loop-type fastener and is a registered U.S. Trademark, e.g., Reg. Nos. 1,027,417 or 1,303,907 (VELCRO V ®). One skilled in the art would choose the particular attaching means 23 appropriate to the defined function of the carrying strap, i.e., detachable, reattachable, or fixed. For example, as can be seen from FIG 9, a carrying strap **22*c* is removably and reattachably fixed to the decoy bag segment 20 at both ends of the carrying strap 22*c*. The male portion of a snap 23*a* is seen to be able to mate with the female portion of the snap 23*b* to form a means for detachably securing the carrying strap 22*c* to the decoy bag segment 20. As can be seen from FIG. 10, a carrying strap 22*d* may be permanently attached to the decoy bag segment 20*a* at one end 23*c* and reattachably attached at the other end by means of the male snap portion 23*a* and female snap portion 23*b* of the attaching means 23. The carrying strap 22 may be made to be adjustable in length by such means as are known to those of skill in the art. For example, as can be seen from FIG. 7, an adjustable carrying strap 22*a* may be made adjustable by means of a buckle assembly 36 and holes 37, or, as is shown in FIG. 8, an adjustable carrying strap 22*b* may be made adjustable by means of a sliding release buckle 38**.

The valuables bag segment 21 is detachably mounted by way of an attaching means 24 to the decoy bag segment 20. The detachable attaching means 24 may comprise a snap fastener or VELCRO or the like. When the decoy bag segment 20 is attached to the valuables bag segment 21, a cavity 25 is formed between the two bag segments. In a preferred embodiment, the cavity 25 is large enough to envelop the handbag holder's hand as the handbag is worn. Any number of attaching means 24 may be incorporated to secure each of the adjacent bags to one another in various embodiments of the invention.

In normal use, the handbag appears to be conventional. The handbag holder drapes the carrying strap 22 over his or her shoulder and lets the bag segments hang down to a comfortable position (usually about the hip or ribcage area when walking or riding normally). The valuables bag segment 21 should be positioned so that it is immediately adjacent to or resting against the body of the handbag holder. Consequently, the adjacent decoy bag segment 20 faces out and away from the body of the handbag holder. The handbag holder then inserts his or her hand into the cavity 25 between the decoy bag segment 20 and the valuables bag segment 21 and keeps that hand in the cavity in normal use. The handbag holder may prefer to grasp the bottom of the valuables bag from within the cavity 25.

Figure 5:
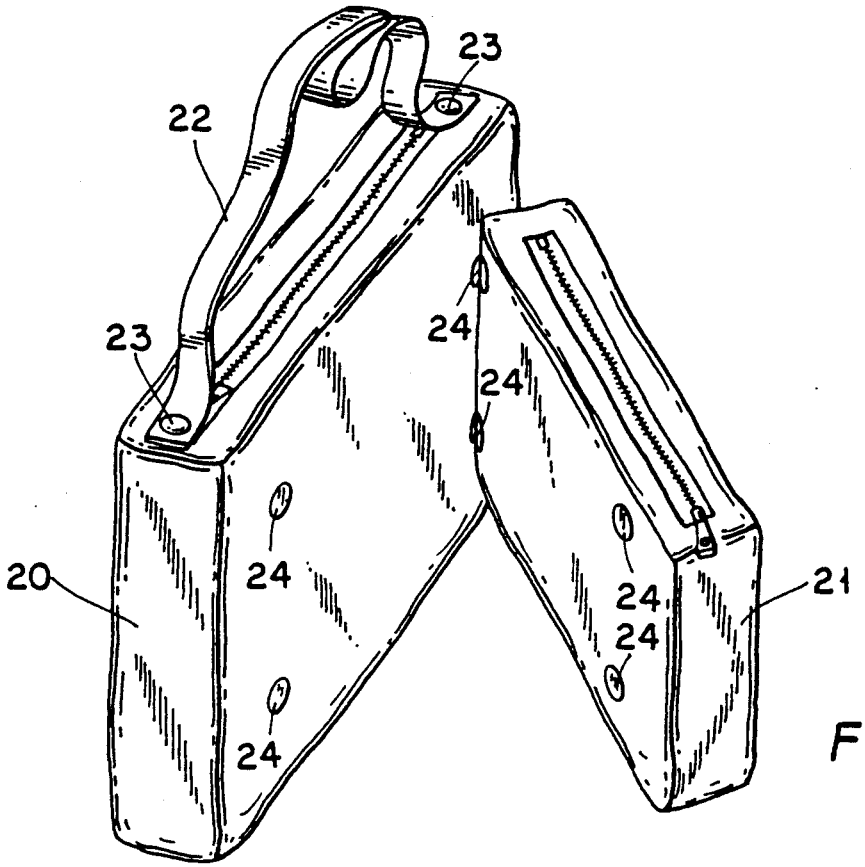
FIG. 5 is a side view of a valuables bag partially separated from a decoy bag.

Should a thief attempt to snatch the handbag by grabbing and then exerting an extraordinary pulling force upon the readily accessible decoy bag segment 20, the decoy bag segment 20 will separate from the valuables bag segment as shown in FIG. 5. Separation will occur at the attaching means 24 when the thief grabs the decoy bag segment 20 or carrying strap 22 and pulls; the hand bag holder is then left holding the valuables bag segment with the hand that had been placed in the cavity 25 while the thief runs off with the decoy bag segment 20.

In a preferred embodiment of the invention, the valuables bag segment 21 is smaller in size than the decoy bag segment 20 and remains hidden from view. An advantage of this sizing arrangement is that the borders of the decoy bag segment 20 protrude out beyond those of the valuables bag segment 21. When a thief grabs the decoy bag segment 20, the thief's hand will grab only the protruding valuables bag segment 21. Furthermore, an oversized decoy bag segment 20 will camouflage the fact that the handbag holder is holding or otherwise securing the smaller valuables bag segment 21.

Occasionally, a handbag holder may drape the carrying strap 22 around his or her neck so that the carrying strap 22 lies across the chest or abdominal region in diagonal fashion. If the thief grabs and pulls the carrying strap 22 and the carrying strap 22 is detachably mounted on the decoy bag segment 20 by the attaching means 23, the carrying strap 22 will detach at one or both of the points at which the carrying strap 22 is attached to the decoy bag segment 20. If only one end of the carrying strap 22 is permanently attached to the decoy bag segment 20, a thief grabbing the carrying strap 22 will abscond with the carrying strap 22 and the permanently attached decoy bag segment 20. If the carrying strap 22 is removably attached at both ends and both ends release, the thief will only abscond with the carrying strap. The advantage of a detachable carrying strap 22 is made apparent under these circumstances because otherwise the handbag holder would be dragged along as the thief pulls the carrying strap 22 or the decoy bag segment 20.

Figure 4:
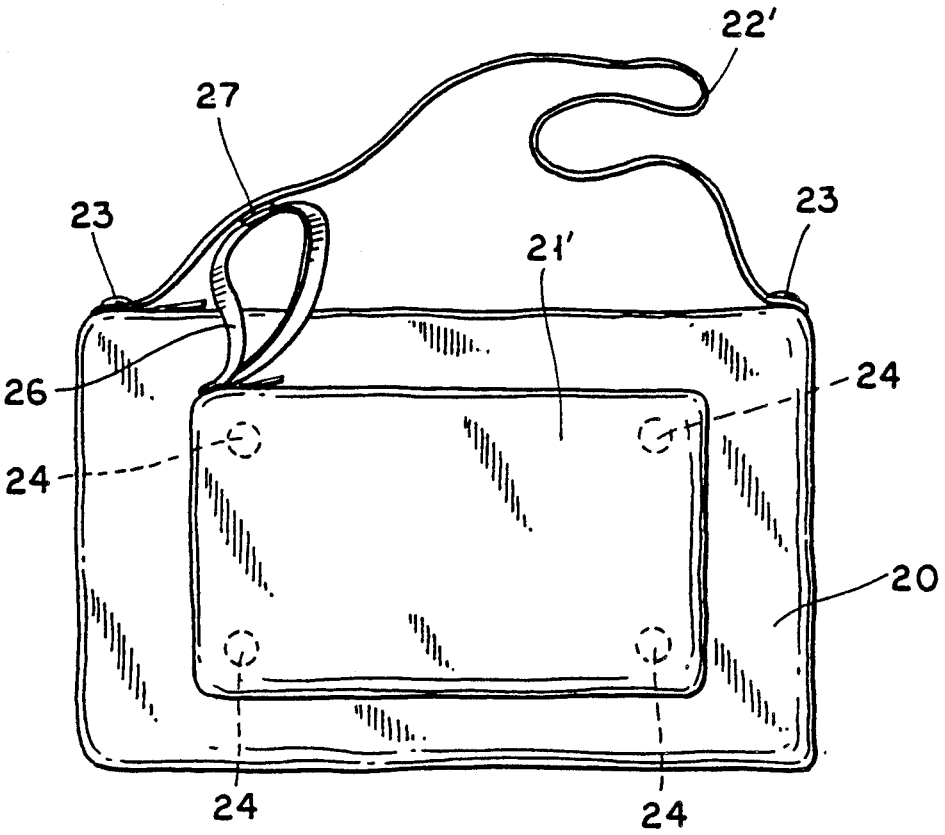
FIG. 4 is a back view of a handbag incorporating a handstrap embodying this invention.
Figure 11:
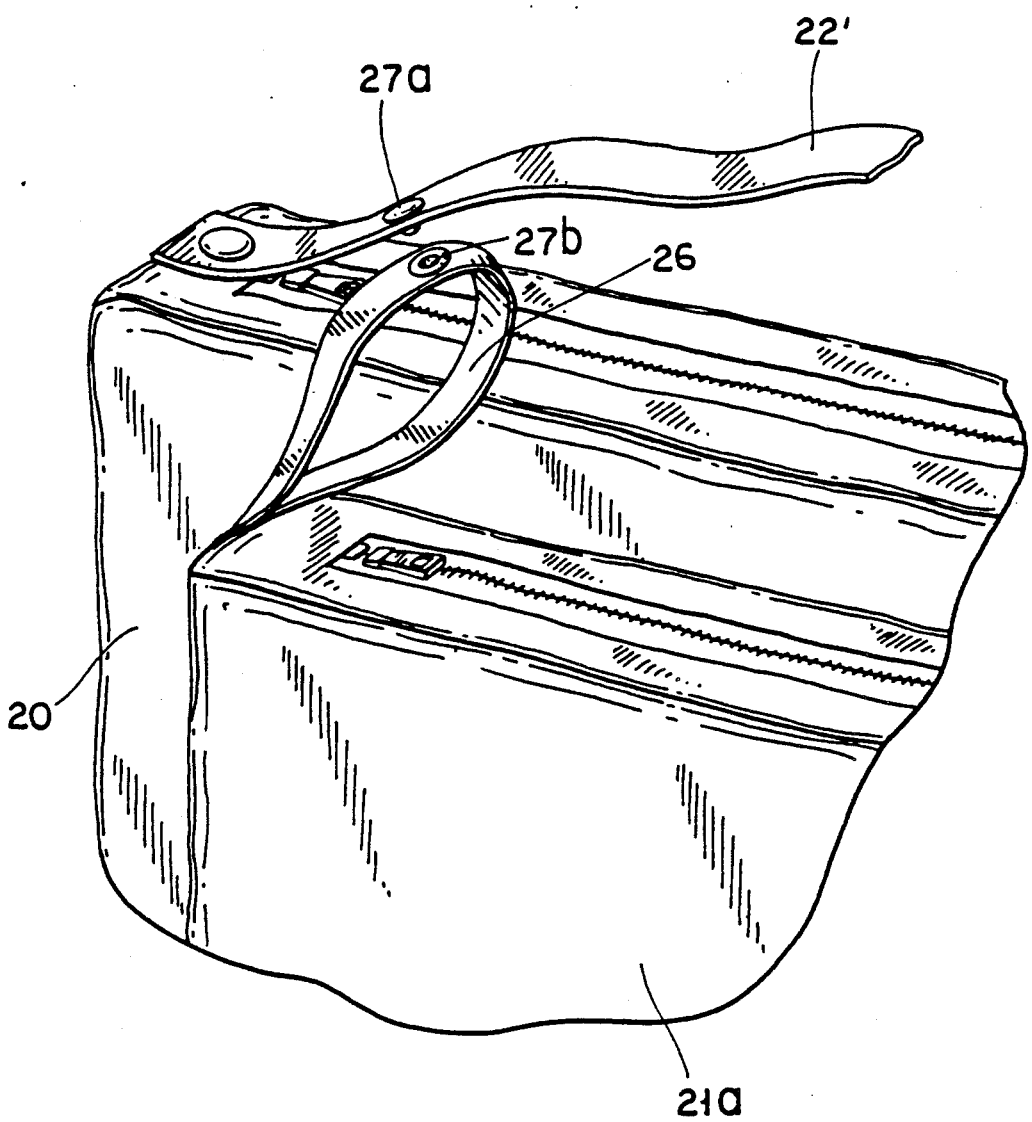
FIG. 11 is a fragmentary view of the anti-theft handbag depicting a hand strap that can be removably attached to a carrying bag.

Referring now to the form shown in FIG. 4 of the drawings, this example of the invention is similar in all respects to the example shown in FIGS. 1 through 3 except that a hand strap 26 is permanently attached to the valuables bag 21' and removably attached to the carrying strap 22' by an attaching means 27. As above, the attaching means may comprise a snap, VELCRO or the like. FIG. 11 illustrates a means by which the hand strap 26 is removably attached to a carrying strap 22'. A male snap portion **27*a* may mate with a female snap portion 27*b* to form a means for removably and reattachably attaching the hand strap 26 to the carrying strap 22'. Alternatively, VELCRO® or other reattachable materials known to those with skill in the art can be used to comprise the attaching means 27**.

In normal use, the handbag holder's hand may rest at the juncture where the carrying strap 22 meets the decoy bag segment 20. In this case, the handbag holder would either hold the hand strap 26 or slide the hand strap 26 around his or her wrist, thus securing the valuables bag segment 21 to the handbag holder. If a thief snatches the handbag by grabbing either the decoy bag segment 20 or the carrying strap 22, the hand strap 26 will separate from the carrying strap 22, the decoy bag segment 20 will separate from the valuables bag segment 21 and the thief will abscond with the decoy bag segment 20 leaving the handbag holder safe with the valuables bag segment.

Figure 6:
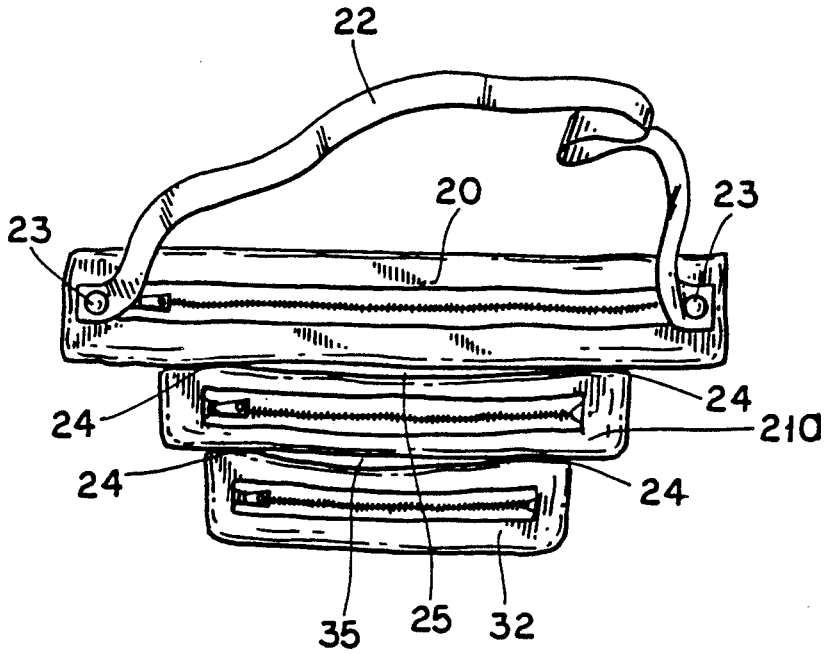
FIG. 6 is a top view of a handbag incorporating multiple bag segments embodying this invention.

Still another form of the invention is shown in FIG. 6 which shows an embodiment with multiple bag segments. In this embodiment, the decoy bag segment 20 is removably attached to a valuables bag segment 21, which is also removably attached to another valuables bag segment 32. The attaching means 24 are reattachable in nature and may comprise snaps, VELCRO or the like. In normal use, the handbag holder can insert his or her hand in either cavity 25 or 35 and grasp either of the valuables bag segments 21 or 32 in a manner similar to that described above.

In FIG. 6 the carrying strap 22 functions as it did in the previous embodiments described. This embodiment may optionally contain a hand strap 26 that functions in a manner similar to the embodiment described in FIG. 4 except that the hand strap can be attached to either valuables bag segment 21 or 32. In another embodiment, there can exist multiple decoy bag segments attached to one or more valuables bag segments.

While the description herein highlights the benefits and advantages of the present invention under the circumstance of a theft, the inventive concept also applies to situations that occur when the carrying strap or decoy bag is inadvertantly hooked to a passing or stationary object. In such situations the present invention functions more as a safety device. For example, a fast-closing subway door may inadvertantly close on a victim's handbag. The instant invention would function as previously described, i.e., separating at the aforementioned attaching means and leaving the victim safe and secure with their valuables. In the case of a moving bicycle rider who inadvertantly catches the carrying strap or decoy bag on a stationary object, the instant invention would function as above to produce the same safe result.

In all the embodiments of this invention, the bag segments may exist in varying sizes and shapes such as square, rectangular, circular or any other shape which may be convenient or pleasing to the eye. It is contemplated that the present inventive concept also encompasses larger size shoulder bags. Furthermore, the bag segments may open and close to reveal storage areas contained within the bag segments. Such opening and closing means may comprise zippers 50 or 50', flaps or any other mechanism which may seal the bag segment that those with skill in the art may apply.

The examples and embodiments depicted in this specification are not intended to be limitations on the inventive concept herein. Accordingly, other modifications in shape, size, form, number or interchangeability of bag segments may be made which are intended to be covered by this invention.

What is claimed is:

1. An anti-theft handbag device comprising two adjacent handbag segments, one handbag segment being larger than the other handbag segment and a means for detachably securing a side of the larger handbag segment to a side of the other handbag segment so that said means mate with each other in between the adjacent handbag segments wherein a cavity means is located between the adjacent handbag segments when they are joined together, said cavity means being capable of receiving and enveloping a hand of the holder of the anti-theft bag and said larger handbag segment having a carrying strap mounted thereon so that upon extraordinary pulling of either the carrying strap or the larger handbag segment, the carrying strap and larger handbag segment will separate along a generally horizontal direction from the other handbag segment.

2. An anti-theft handbag device as defined in claim 1 wherein one end of the carrying strap is permanently attached to the larger handbag segment and the other end of the carrying strap is comprised of a means for being removably and reattachably mounted to the larger handbag segment whereby upon extraordinary pulling the strap will separate at the point of the removable and reattachable mounting means.

3. An anti-theft handbag as defined in claim 1 wherein both ends of the carrying strap are comprised of means for removably and reattachably mounting the carrying strap to the larger handbag segment whereby upon extraordinary pulling the strap will separate from said larger handbag segment at the point of the removable and reattachable mounting means.

4. An anti-theft handbag device as defined in claim 1 wherein both ends of the carrying strap are permanently attached to the larger handbag segment.

5. An anti-theft handbag device as defined in claim 1 wherein a hand strap is attached to said other handbag segment.

6. An anti-theft handbag device as defined in claim 5 wherein the hand strap is comprised of a means for removably and reattachably attaching the handstrap to the carrying strap so that upon extraordinary pulling the hand strap will separate from the carrying strap.

7. An anti-theft handbag device comprising at least two adjacent handbag segments, wherein one of the adjacent handbag segments has a carrying strap mounted thereon, wherein the carrying strap is comprised of a means for being removably and reattachably mounted at at least one end whereby upon extraordinary pulling the strap will separate from said one of the adjacent handbag segments at the point of the removable and reattachable mounting means, said handbag device further comprised of means for detachably securing an exterior side of one of the handbag segments to an exterior side of the other so that said means mate with each other in between the adjacent handbag segments whereby upon extraordinary pulling said handbag segments will separate along a generally horizontal direction.

8. An anti-theft handbag device as defined in claim 7 wherein both ends of the carrying strap are comprised of means for removably and reattachably mounting the carrying strap to said one of the adjacent handbag segments.

9. An anti-theft handbag device as defined in claim 7 wherein one end of the carrying strap is permanently mounted to said one of the adjacent handbag segments.

10. An anti-theft handbag device as defined in claim 7 wherein the carrying strap is adjustable in length.

11. An anti-theft handbag device as defined in claim 7 wherein a cavity means is located between each adjacent handbag segment when they are joined together, said cavity means being capable of receiving and enveloping a hand of the holder of the anti-cavity handbag.

12. An anti-theft handbag device as defined in claim 7 wherein a hand strap is attached to one or more adjacent handbag segments which do not have the carrying strap mounted thereon.

13. An anti-theft handbag device as defined in claim 12 wherein the hand strap is comprised of a means for removably and reattachably attaching the handstrap to the carrying strap so that upon extraordinary pulling the handstrap will separate from the carrying strap.

14. An anti-theft handbag device as defined in claim 7 wherein the adjacent bag segments are of varying sizes.

15. An anti-theft handbag device comprising at least two adjacent handbag segments and means for detachably securing an exterior side of one of the handbag segments to an exterior side of the other so that said means mate with each other in between the adjacent handbag segments such that a cavity means is located between each adjacent segment which they are joined together, said cavity means being capable of receiving and enveloping a hand of the holder of the anti-theft handbag, whereby upon extraordinary pulling said handbag segments will separate along a generally horizontal direction.

16. A method of securing valuables which comprises (1) removably attaching adjacent bag segments to one another so that a cavity is created between each adjacent bag segment; (2) removably attaching at least one end of a carrying strap to one of the adjacent bag segments; (3) positioning the bag segments so that the bag segment having the carrying strap mounted to it is facing outward from the body of the adjacent bag segments holder and another of said bag segments is thus facing in and against the body of said bag segments holder; (4) placing the carrying strap over a shoulder of said bag segments holder so that the adjacent bag segments hang and are supported by said carrying strap; and (5) placing a hand of said bag segments holder into the cavity in such a manner as to allow said bag segments holder to grasp the bag segment that faces in and against the body of said bag segments holder thus creating an outermost decoy bag and an innermost valuables bag which would remain secure to said bag segments holder when extraordinary pulling is exerted upon the outermost decoy bag or carrying strap thereby causing a separation of the adjacent bag segments or carrying strap.

17. A method of securing valuables as defined in claim 16 wherein one end of the carrying strap is removably attached and the other end of the carrying strap is permanently attached to one of the adjacent bag segments.

18. A method of securing valuables as defined in claim 16 wherein both ends of the carrying strap are removably attached to one of the adjacent bag segments.

* * * * *